US006973676B1

(12) United States Patent
Simpson

(10) Patent No.: US 6,973,676 B1
(45) Date of Patent: Dec. 13, 2005

(54) PROTECTIVE HELMET WITH INTEGRAL AIR SUPPLY

(76) Inventor: Elwood Jesse Bill Simpson, 1650 Northfield Dr., Brownsburg, IN (US) 46112

( * ) Notice: Subject to any disclaimer, the term of this patent is extended or adjusted under 35 U.S.C. 154(b) by 80 days.

(21) Appl. No.: 10/779,937

(22) Filed: Feb. 17, 2004

Related U.S. Application Data

(63) Continuation-in-part of application No. 29/189,284, filed on Sep. 2, 2003, now Pat. No. Des. 492,817, and a continuation-in-part of application No. 29/189,277, filed on Sep. 2, 2003, now Pat. No. Des. 498,883.

(51) Int. Cl.[7] ..... A42C 5/04
(52) U.S. Cl. ..... 2/171.3; 128/201.24
(58) Field of Search ..... 2/906, 411, 412, 2/424, 171.3, 410, 414, 425, 7, 436, 437, 2/422; 128/200.28, 201.15, 201.23, 201.25, 128/201.24

(56) References Cited

U.S. PATENT DOCUMENTS

| | | | | |
|---|---|---|---|---|
| 2,688,962 A | * | 9/1954 | Summers | 128/201.15 |
| 3,293,659 A | * | 12/1966 | Shepard | 128/201.15 |
| 3,362,403 A | | 1/1968 | Fleming et al. | |
| 3,413,972 A | * | 12/1968 | Depping | 128/201.23 |
| 3,657,740 A | * | 4/1972 | Cialone | 128/205.25 |
| 3,702,607 A | * | 11/1972 | Tucker et al. | 128/201.14 |
| 4,054,953 A | | 10/1977 | De Barsy | |
| 4,126,131 A | | 11/1978 | Davis et al. | |
| 4,549,541 A | | 10/1985 | Sundahl | |
| 4,575,875 A | | 3/1986 | Dawson et al. | |
| 4,581,775 A | | 4/1986 | Nava | |
| 4,584,721 A | | 4/1986 | Yamamoto | |
| 4,586,200 A | | 5/1986 | Poon | |
| 4,918,752 A | | 4/1990 | Briggs | |
| 4,964,178 A | * | 10/1990 | Giancarlo et al. | 2/414 |
| 5,039,035 A | | 8/1991 | Fitzpatrick | |
| 5,050,240 A | * | 9/1991 | Sayre | 2/6.2 |
| 5,146,757 A | | 9/1992 | Dearing | |
| 5,156,145 A | | 10/1992 | Flood et al. | |
| 5,165,116 A | | 11/1992 | Simpson | |
| 5,283,914 A | * | 2/1994 | James | 2/424 |
| 5,345,614 A | | 9/1994 | Tanaka | |
| 5,365,615 A | | 11/1994 | Piszkin | |
| 5,533,500 A | * | 7/1996 | Her-Mou | 128/201.25 |
| 5,575,018 A | | 11/1996 | Rothrock | |
| 5,991,930 A | | 11/1999 | Sorrentino | |
| 6,061,834 A | | 5/2000 | Liao | |
| 6,081,929 A | | 7/2000 | Rothrock et al. | |

(Continued)

FOREIGN PATENT DOCUMENTS

JP 10053916 A * 2/1998 ..... A42B 03/28

*Primary Examiner*—Rodney M. Lindsey
(74) *Attorney, Agent, or Firm*—Woodard, Emhardt, Moriarty, McNett & Henry LLP

(57) ABSTRACT

Protective helmet device includes a helmet with a hard outer shell and a soft inner lining. In one embodiment, a tube inlet with multiple channels is coupled to the top of the outer shell, and is operative to allow the helmet to be connected to an air supply. In another embodiment, an insert on the inside of helmet contains multiple channels that are coupled to the tube inlet of the outer shell. Slots are contained in inner liner to allow air to flow from the air supply to the tube inlet, through the channels, and into the interior of the helmet. Air blows downward to keep carbon monoxide from coming up into the helmet, to keep air from blowing into the wearer's eyes, and to clear the shield.

11 Claims, 15 Drawing Sheets

U.S. PATENT DOCUMENTS 6,112,333 A 9/2000 Mazzei
6,247,186 B1 * 6/2001 Huang ..... 2/410
6,250,299 B1 6/2001 Danisch et al.
6,405,382 B2 6/2002 Shida
6,766,537 B1 * 7/2004 Maki et al. ..... 2/171.3
6,792,951 B2 9/2004 Evonitz, III
2001/0039674 A1 11/2001 Shida
2003/0188375 A1 10/2003 Wilson et al.

* cited by examiner

PROTECTIVE HELMET WITH INTEGRAL AIR SUPPLY

CROSS-REFERENCE TO RELATED APPLICATIONS

The present application is a continuation-in-part of application Ser. No. 29/189,284 filed Sep. 2, 2003 now U.S. Pat. No. Des. 492,817 and of application Ser. No. 29/189,277 filed Sep. 2, 2003 now U.S. Pat. No. Des. 498,883.

BACKGROUND OF THE INVENTION

The present invention relates to protective helmets, and more particularly, but not exclusively, relates to protective helmets used in high speed racing events.

In the racing industry, fast cars exhaust strong fumes, such as carbon monoxide. To keep the driver from breathing these fumes, air supply systems have been developed. For example, many race cars, such as Winston Cup cars, have air conditioning systems with a carbon monoxide filter in the back of the car. With such a system, the driver may wear a helmet that has a tube inlet on the side for connecting to the air conditioning system air supply. Air is blown into the helmet through the side inlet. Such an air conditioning system helps cool the driver and also helps keep the driver from breathing induction air with carbon monoxide and other fumes. However, these current systems tend to bounce air off of the helmet visor shield and into the driver's eyes, thereby causing dryness of the eyes. These prior art helmets also tend to exacerbate fogging of the shield. There is therefore a need for advancement in this area.

SUMMARY OF THE INVENTION

One object of the present invention is to provide a novel protective helmet. Another object is to provide a novel protective helmet with integral air supply.

In one embodiment, the invention is a protective helmet device that comprises a helmet with an impact-resistant outer shell and an impact-absorbing insert. A tube inlet with integral multiple channels is coupled to the top of the outer shell, and is operative to allow the helmet to be connected to an air supply. Slots are contained in the insert to allow air to flow from the air supply to the tube inlet, through the channels, through the slots, and into the interior of the helmet. Air blows downward to keep carbon monoxide from coming up into the helmet, to keep air from blowing into the wearer's eyes, and to clear the shield.

In another embodiment, the invention is a protective helmet device that comprises a helmet with an impact-resistant outer shell and an impact-absorbing insert. A tube inlet is coupled to the top of the outer shell, and is operative to allow the helmet to be connected to an air supply. The insert on the inside of helmet contains multiple channels that are coupled to the tube inlet of the outer shell. Slots are also formed in the insert to allow air to flow from the air supply to the tube inlet, through the channels, through the slots, and into the interior of the helmet. Air blows downward to keep carbon monoxide from coming up into the helmet, to keep air from blowing into the wearer's eyes, and to clear the shield.

In another embodiment of the present invention, a protective helmet is disclosed comprising a helmet shell formed from an impact-resistant material and having a top portion, a front portion, and an interior, a shield coupled to the front portion of the shell, an insert formed from an impact-absorbing material positioned in the interior of the helmet, the insert having at least one slot formed therein and extending through the insert, a tube inlet coupled to a top portion of the shell, said inlet operable to be connected to a source of air, the tube inlet comprising at least one channel extending from a proximal channel end at the top portion of the shell to a distal channel end at the front portion of the shell above the shield, wherein the distal channel end is adjacent the at least one slot; and wherein the tube inlet, the at least one channel, and the at least one slot are constructed so that when the tube inlet is connected to the source of air, air travels downward into the tube inlet, through the at least one channel, through the at least one slot, and into the interior of the helmet.

In yet another embodiment of the present invention, a protective helmet is disclosed comprising a helmet shell for protectively enclosing a wearer's head, the helmet having a top portion, a front portion, and an interior, a shield coupled to a front portion of the shell, an insert positioned in the interior of the shell for receiving the wearer's head, the insert having at least one channel formed therein and extending from a proximal end adjacent the top portion of the shell down to a distal end adjacent front portion of the shell, the insert further having at least one slot formed therein and extending through the insert, each of the at least one slots communicating for air flow with a respective one of the at least one channels, a tube inlet coupled to the top portion of the shell, the inlet operable to be connected to a source of air, wherein the tube inlet, the plurality of channels, and the plurality of slots are constructed so that when the tube inlet is connected to the source of air, air travels downward into tube inlet, through the plurality of channels, through the plurality of slots, and into the interior of the helmet.

In yet a further embodiment of the present invention, a protective helmet having an interior comprising a helmet shell for protectively enclosing a wearer's head, the helmet shell having a frontal hemisphere, a rear hemisphere, a top portion, and an interior, wherein the top portion extends into both the frontal and rear hemisphere and is the area of the helmet shell that protects the top of the wearer's head, wherein the frontal hemisphere is a front portion of the helmet shell that protects a wearer's face, wherein the rear hemisphere is the other portion of the helmet shell that protects the back of the wearer's head, wherein the interior is defined and enclosed by the shell; a shield coupled to the frontal hemisphere of the shell; an insert positioned in the interior of the shell for receiving the wearer's head, the insert having at least one channel formed therein and extending from a proximal end adjacent the top portion of the shell to a distal end generally adjacent the shield, the at least one channel enclosed within the frontal hemisphere, the insert further having at least one slot formed therein and extending through the insert, each of the at least one slots in fluid communication with a respective one of the at least one channels; a tube inlet coupled to the top portion of the shell and in fluid communication with a portion of the at least one channel for airflow therebetween, the inlet operable to be connected to a source of air, wherein the tube inlet, the at least one channel, and the at least one slot are constructed so that when the tube inlet is connected to the source of air, air travels downward into the tube inlet, through the at least one channel, through the at least one slot, and into the interior of the helmet.

Further forms, embodiments, objects, advantages, benefits, features, and aspects of the present invention will become apparent from the detailed description and drawings contained herein.

DETAILED DESCRIPTION OF SELECTED EMBODIMENTS

Figure 1:
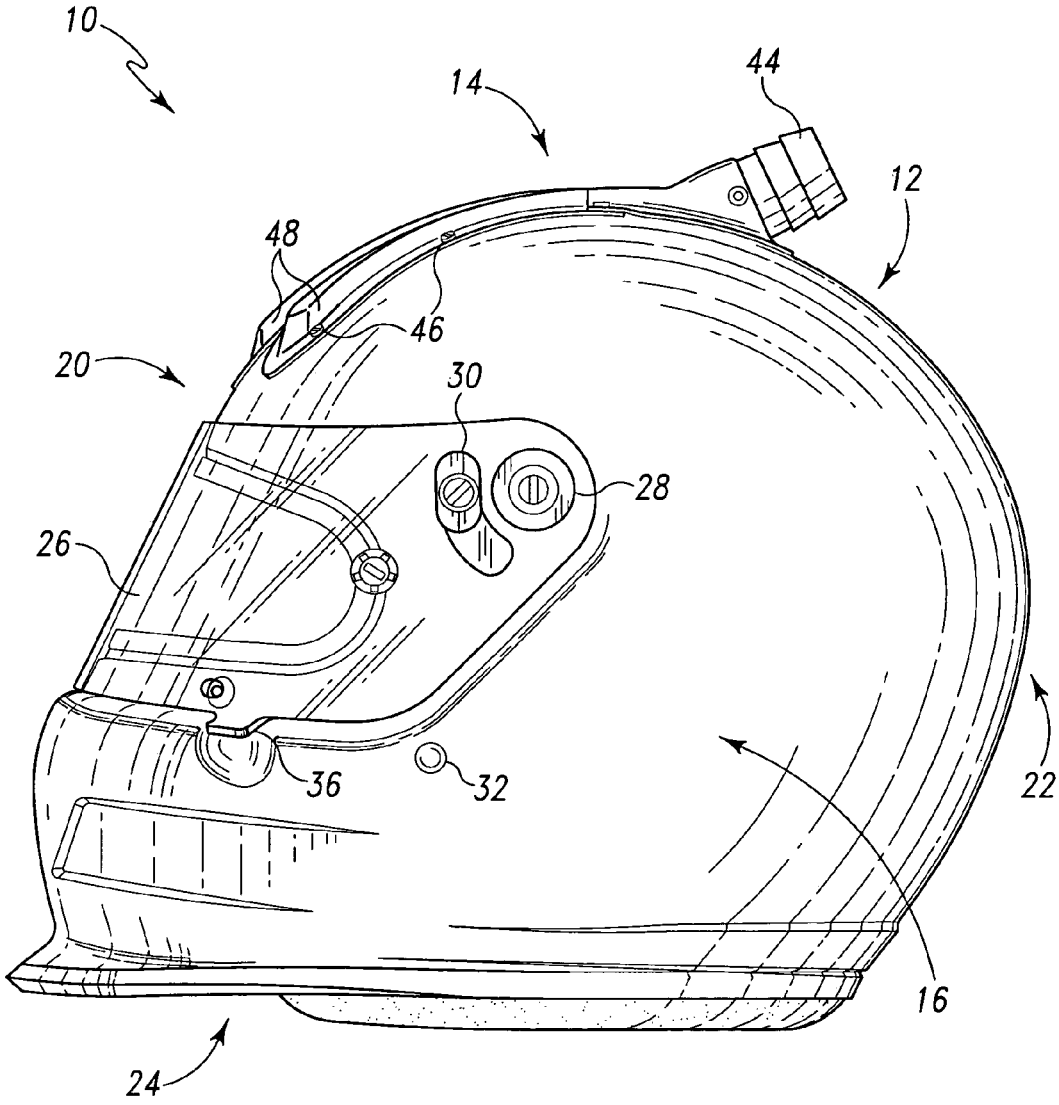
FIG. 1 is a side perspective view of a protective helmet device of a first embodiment of the present invention.
Figure 2:
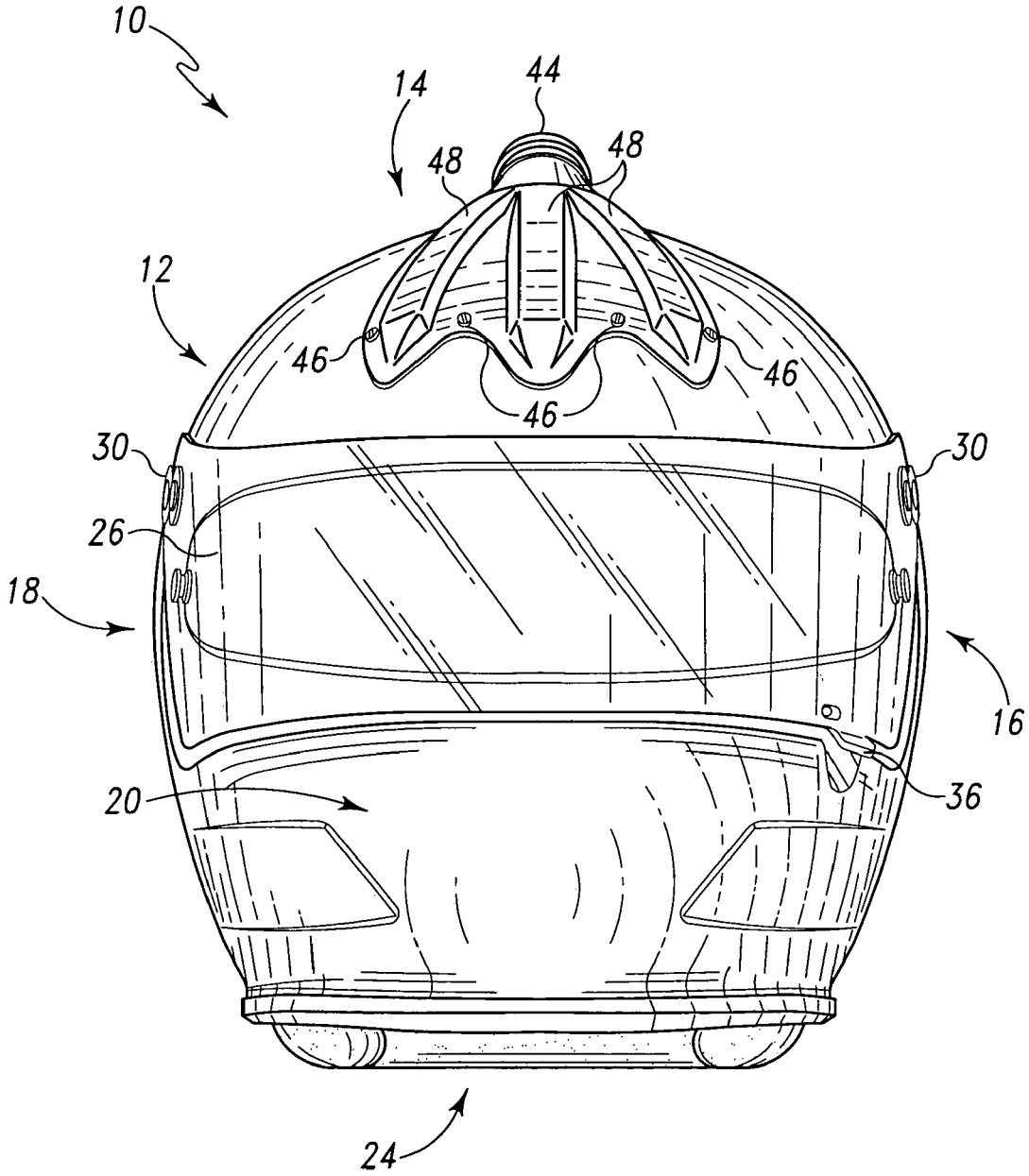
FIG. 2 is a front perspective view of the protective helmet device of FIG. 1.
Figure 3:
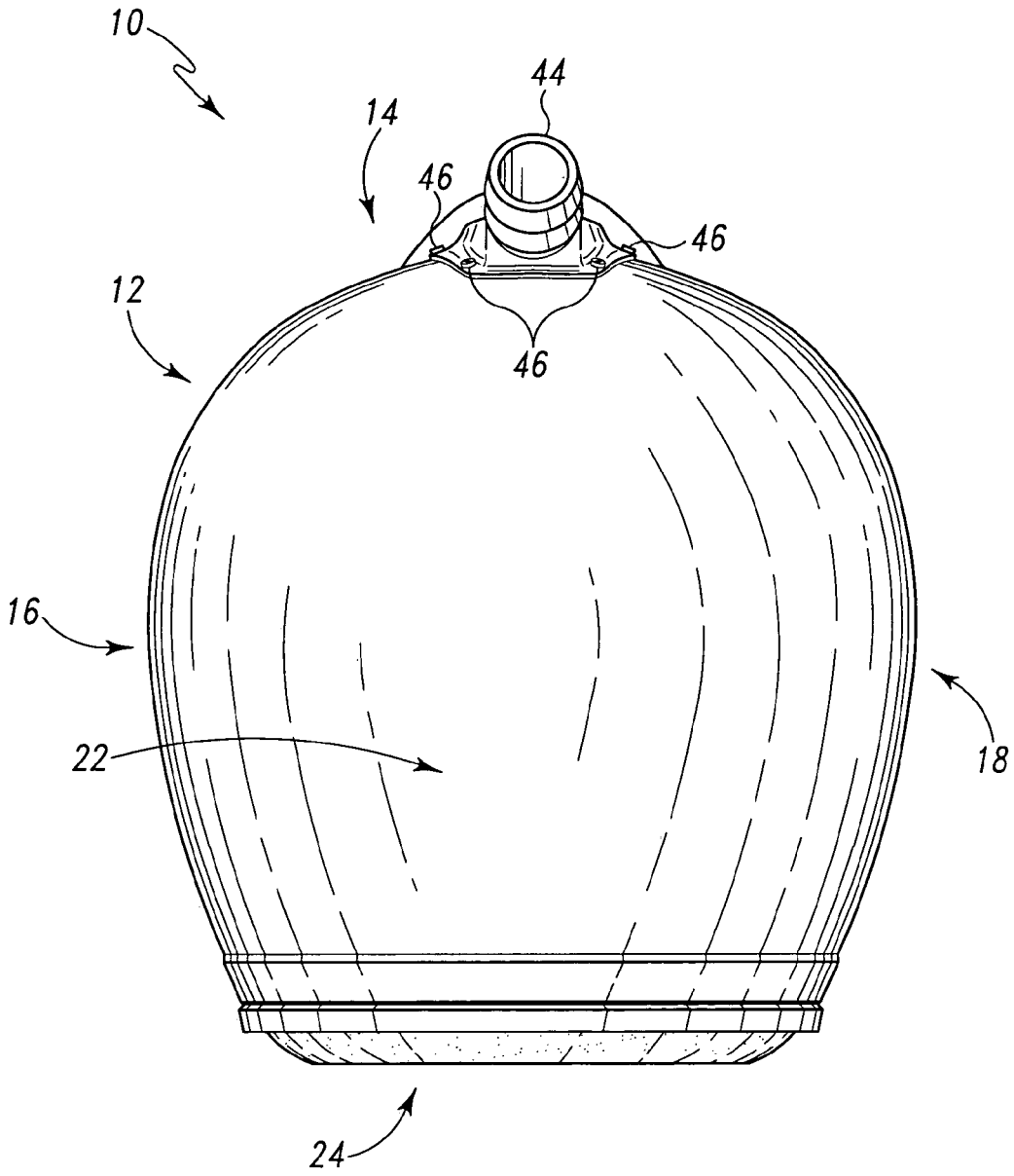
FIG. 3 is a rear perspective view of the protective helmet device of FIG. 1.
Figure 4:
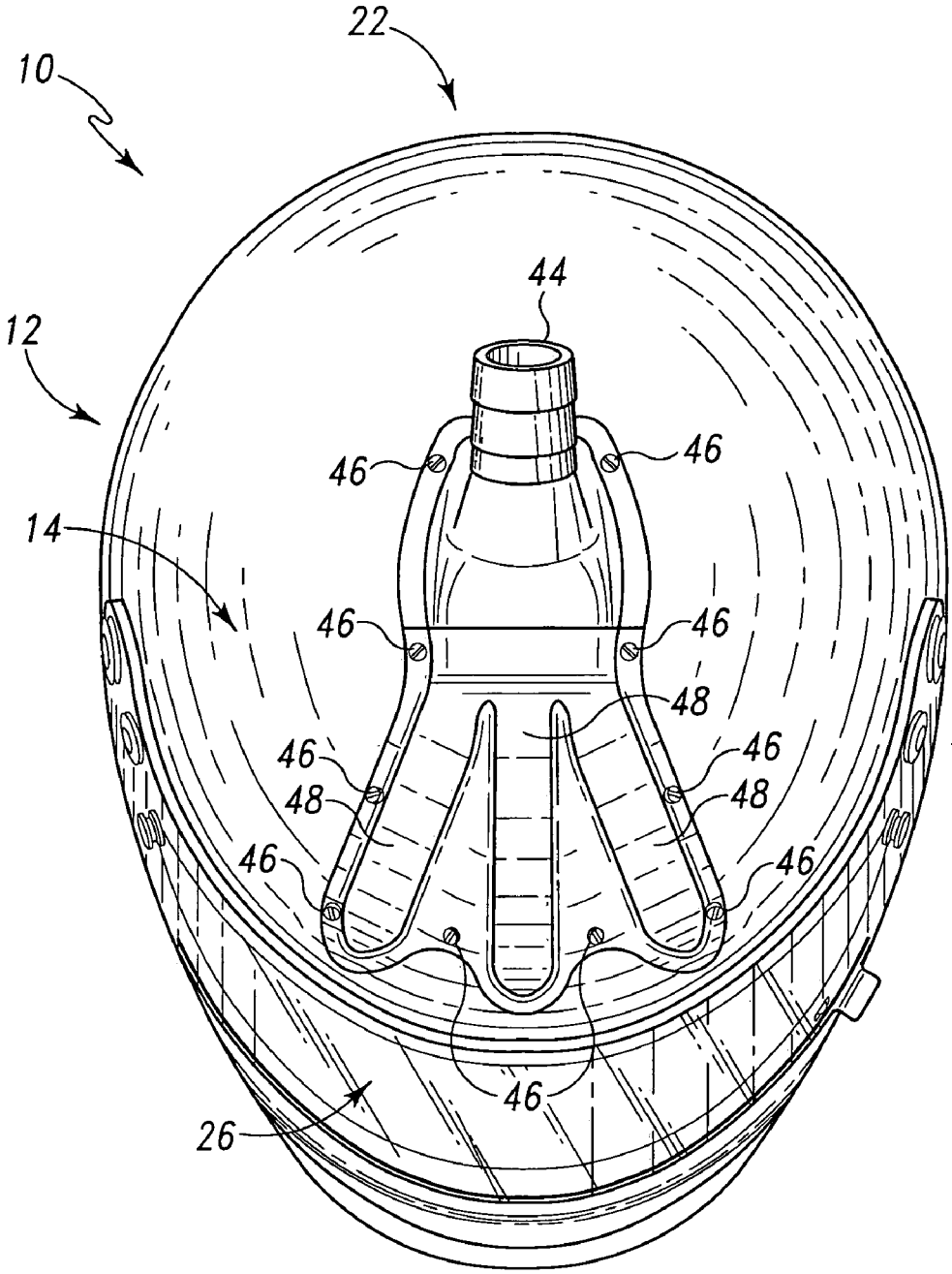
FIG. 4 is a top perspective view of the protective helmet device of FIG. 1.
Figure 5:
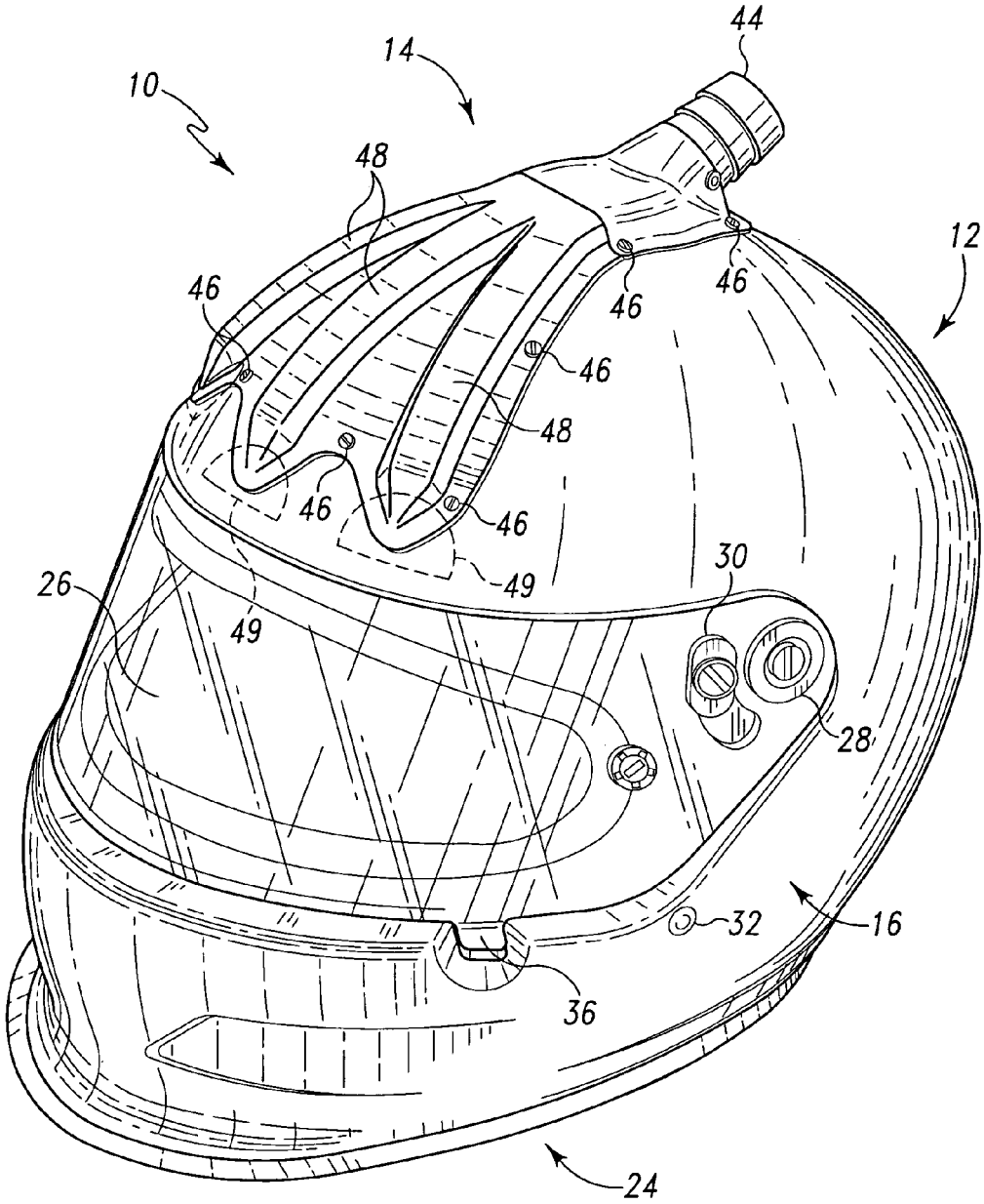
FIG. 5 shows a side perspective view of the protective helmet device of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The present invention provides a method and apparatus for a protective helmet with an integral air supply. Reference will now be made to FIGS. 1–15, with the same reference numerals used to refer to the same parts throughout.

A first embodiment protective helmet is illustrated in FIGS. 1–6. As shown in FIGS. 1–5, protective helmet 10 includes a hard, three-dimensionally shaped outer shell 12 with a top side 14, left side 16, right side 18, front side 20, rear side 22, and bottom side 24. The shell 12 may be formed from any suitable impact-resistant material as is known in the art, such as plastic, fiber-reinforced plastic, carbon-fiber composite or other composite materials. The helmet is of a full-face design that completely covers the wearer's head. Shield 26 is on front side 20 and is mounted on the helmet by left and right pivoting mounting members 28 and held in place in an open or closed position by stops 30. Left and right lugs 32 are provided to bolt the helmet's chin strap 34 (see FIG. 6) to the helmet's outer shell 12. Grip 36 aids in opening and closing shield 26.

Figure 6:
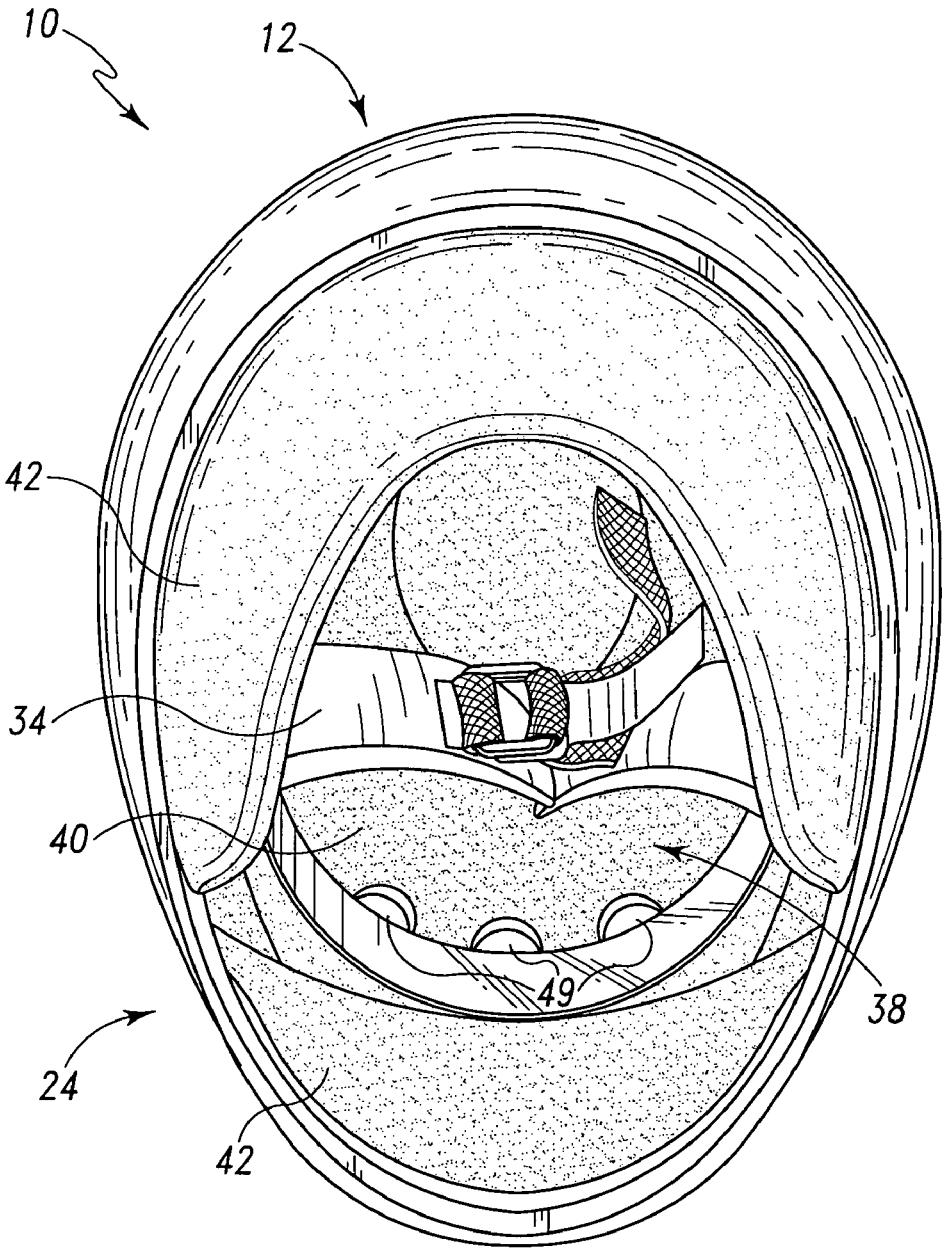
FIG. 6 is an interior perspective view of the protective helmet device of FIG. 1.
Figure 7:
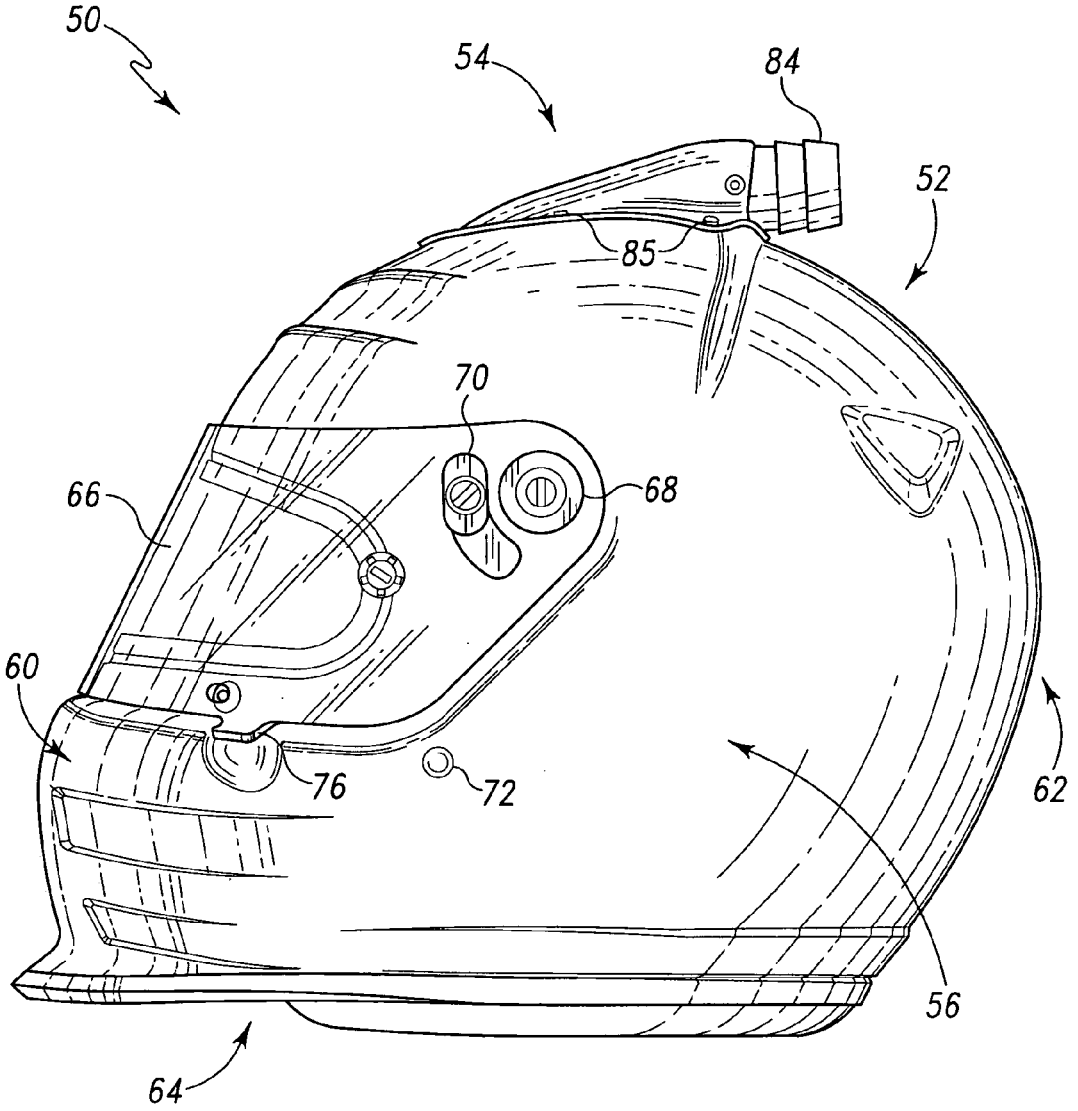
FIG. 7 is a side perspective view of a protective helmet device of a second embodiment of the present invention.
Figure 8:
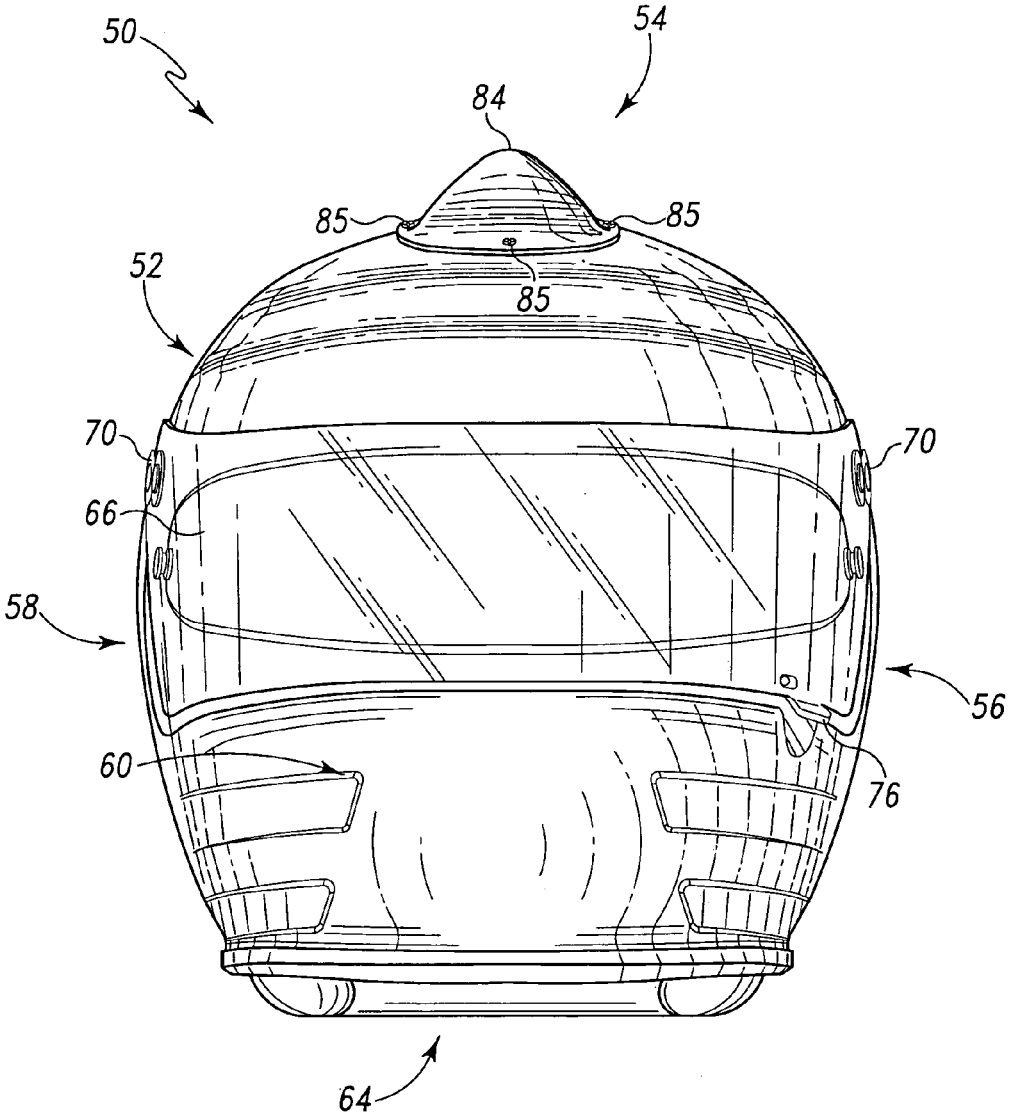
FIG. 8 is a front perspective view of the protective helmet device of FIG. 2.
Figure 9:
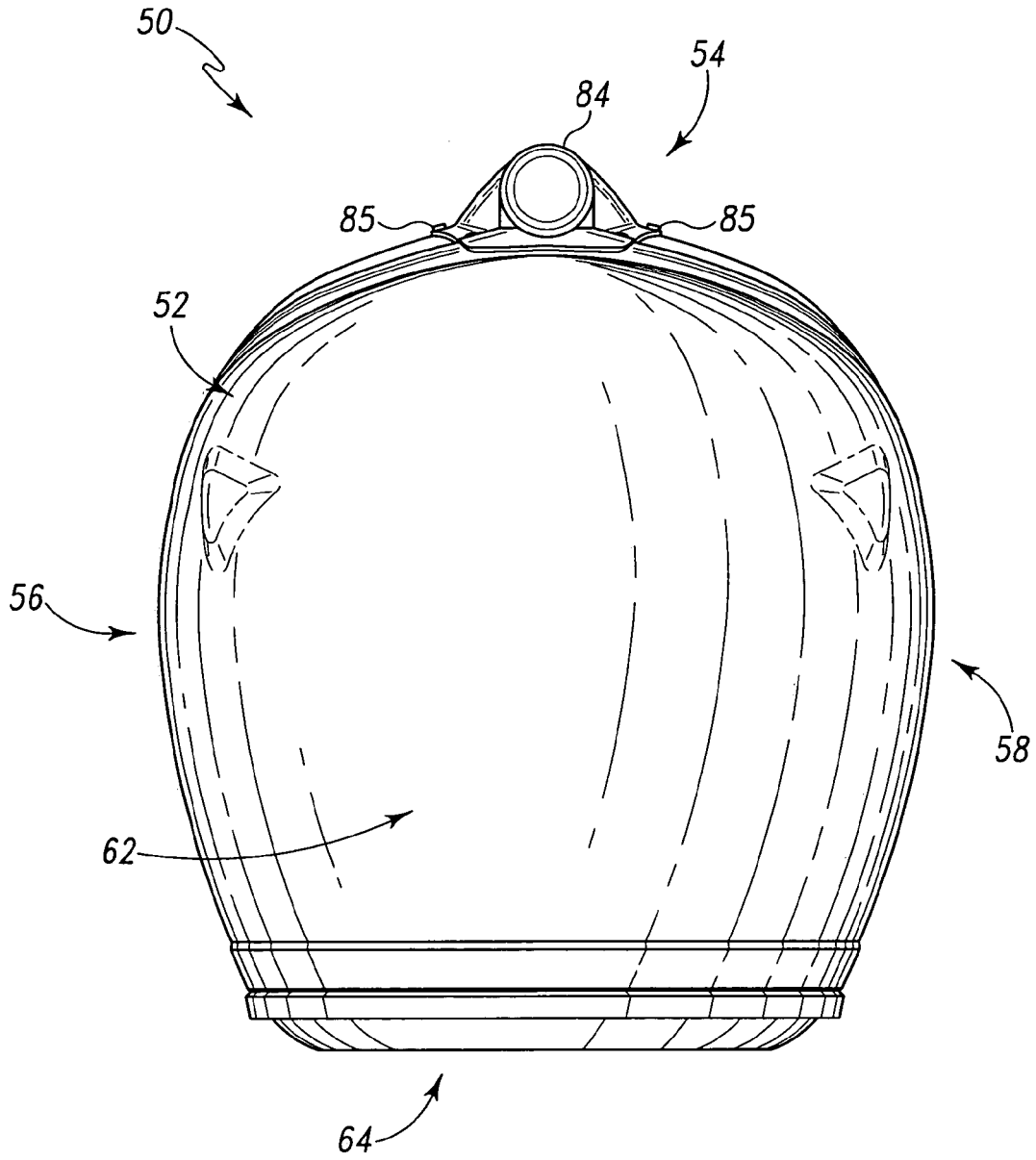
FIG. 9 is a rear perspective view of the protective helmet device of FIG. 2.
Figure 10:
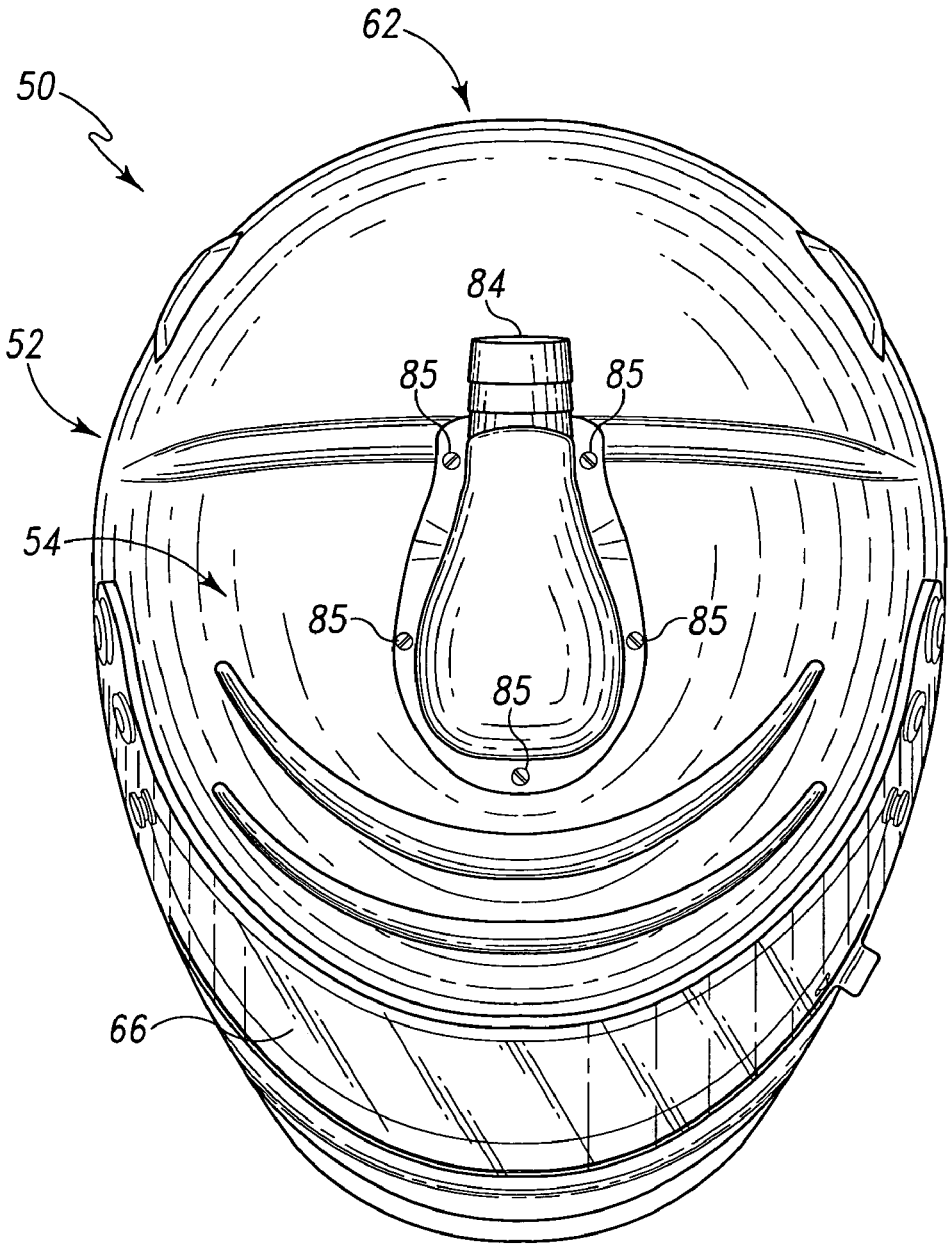
FIG. 10 is a top perspective view of the protective helmet device of FIG. 2.
Figure 11:
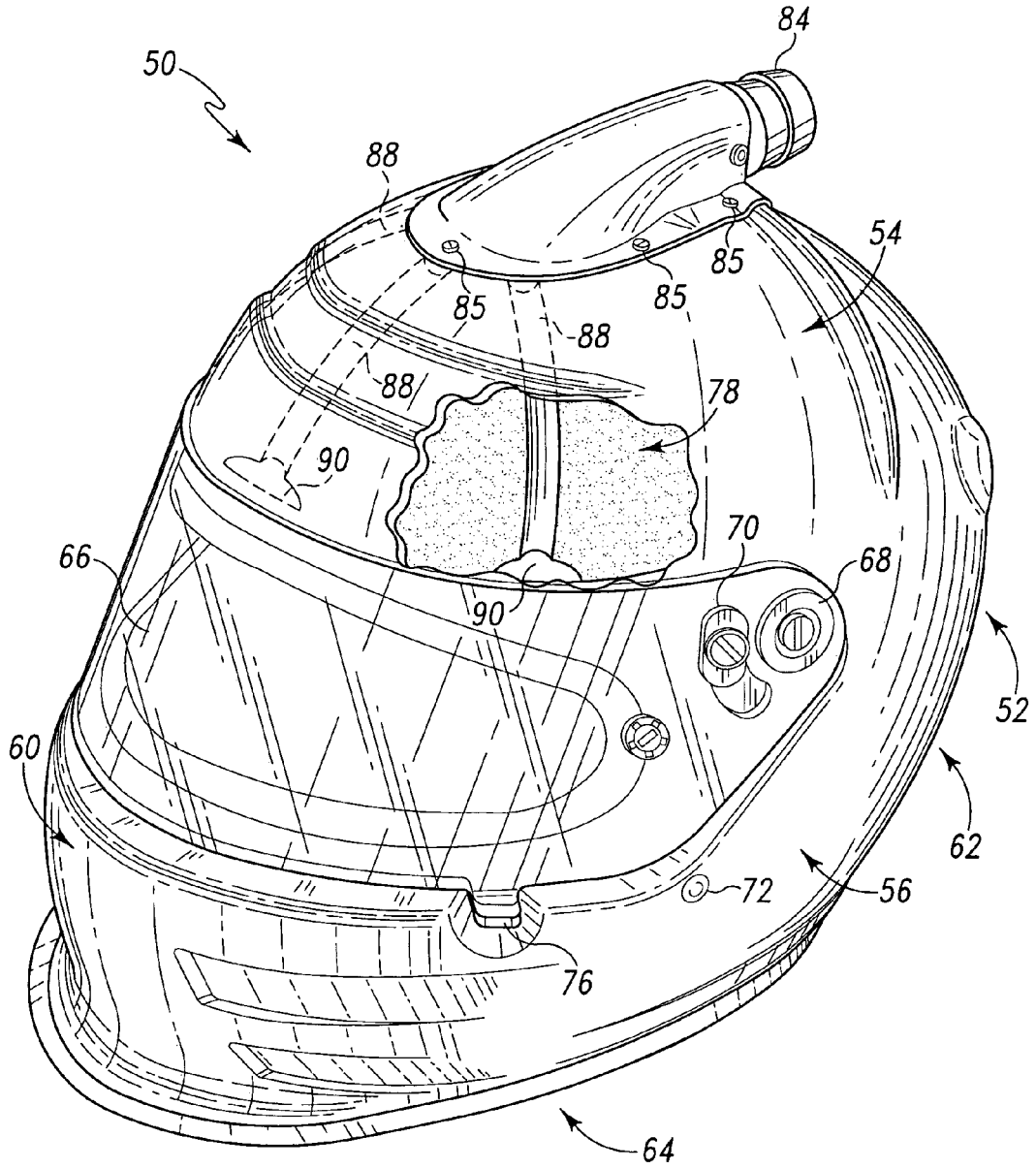
FIG. 11 shows a side perspective view of the protective helmet device of FIG. 2, with a cutaway showing the insert.

As shown in FIG. 6, protective helmet 10 also includes an insert 38 preferably comprising an impact-absorbing core (such as expanded bead polystyrene, polypropylene, or other suitable material as is known in the art) covered with an optional soft inner liner 40. The impact-absorbing insert 38 is coupled to the interior of shell 12. Bottom side 24 is open to allow entry of the wearer's head and has a protective flange 42 at the lowermost edge of the opening.

Referring now to FIGS. 1–6, tube inlet 44 is coupled to the outer shell 12 on the top side 14. Tube inlet 44 is also preferably made out of an impact-resistant material and is fastened to outer shell 12 via securing means 46, such as screws, glue, ultrasonic welding, or other suitable bonding means. Alternatively, tube inlet 44 may be formed integrally with shell 12. Tube inlet 44 is adapted to be coupled to an air supply, such as a race car's air conditioning system. Tube inlet 44 includes multiple channels 48 that preferably extend from a proximal end adjacent top side 14 to a distal end adjacent the upper portion of front side 20. The space within channels 48 may be formed between the interior of tube inlet 44 and the exterior of shell 12, or between the interior of the tube inlet 44 and the exterior of insert 38 (in designs where the tube inlet is formed integrally with shell 12). Shell 12 (in non-integrally formed versions), insert 38, and liner 40 contain slots 49 aligned adjacent to the distal ends of channels 48 that allow air to flow from channels 48 to the interior of the helmet 10. Slots 49 are approximately ⅜ inch in diameter in a preferred embodiment. Optionally, additional holes (not shown) may be formed through the shell 12 and insert 38 near the proximal end of the tube inlet (i.e. near the entrance from the air supply) in order to supply cooling air to the top of the driver's head.

When connected to an external air source, tube inlet 44 supplies air inside the helmet. Air travels into tube inlet 44, through channels 48, through slots 49 and into the interior of the helmet 10. With the design of FIGS. 1–6, air is blown downward, which clears the shield 26 of fog, keeps carbon monoxide from coming up into the helmet, and/or keeps air from blowing into and drying out the wearer's eyes.

A second embodiment protective helmet is illustrated in FIGS. 7–15. As shown in FIGS. 7–12, protective helmet 50 includes a hard, three-dimensionally shaped outer shell 52 with a top side 54, left side 56, right side 58, front side 60, rear side 62, and bottom side 64. The shell 52 may be formed from any suitable impact-resistant material as is known in the art, such as plastic, fiber-reinforced plastic, carbon-fiber composite or other composite materials. The helmet is of a full-face design that completely covers the wearer's head. Shield 66 is on front side 60 and is mounted on the helmet by left and right pivoting mounting members 68 and held in place in an open or closed position by stops 70. Left and right lugs 72 are provided to bolt the helmet's chin strap 74 (see FIG. 12) to the helmet's outer shell 52. Grip 76 aids in opening and closing shield 66.

Figure 12:
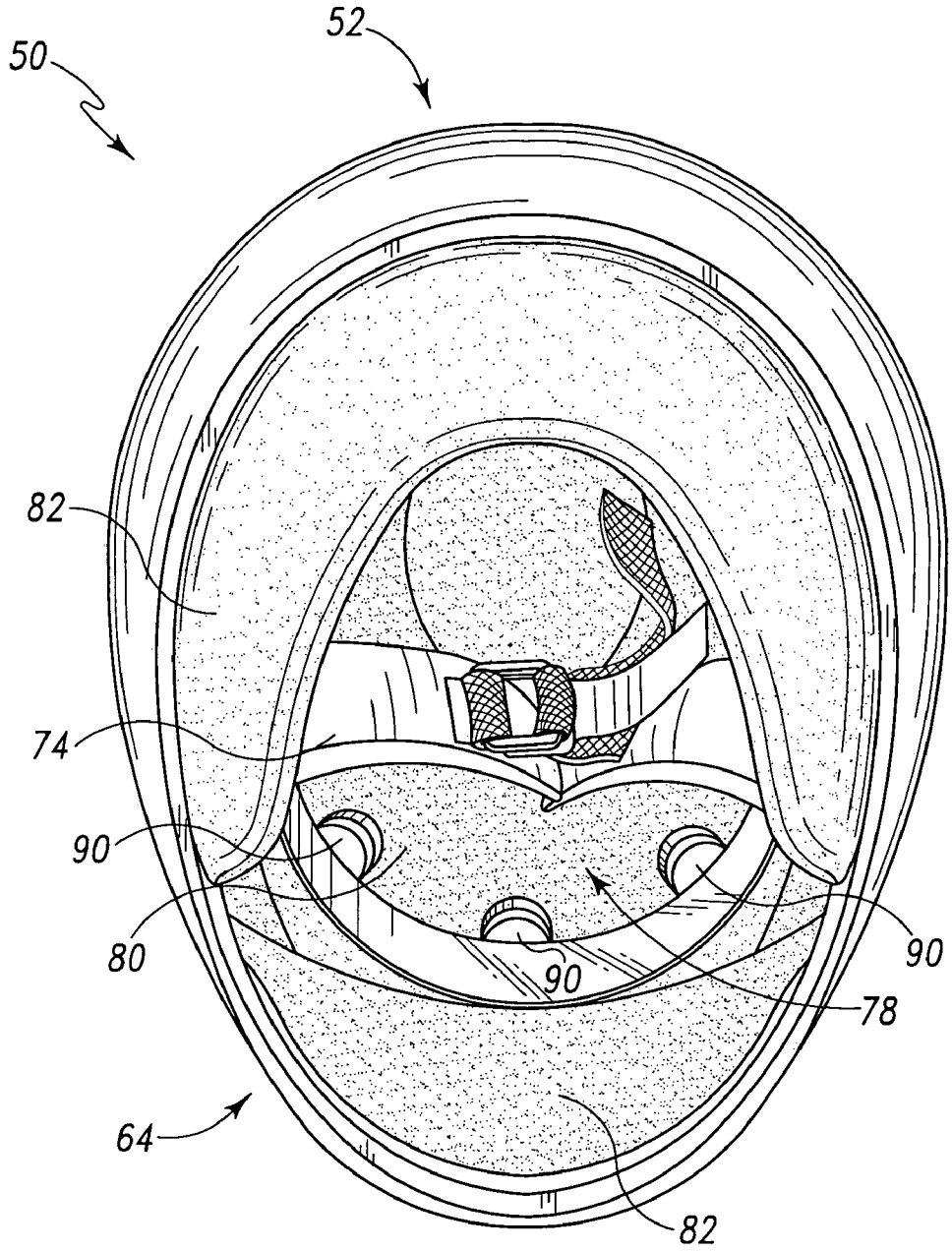
FIG. 12 is an interior perspective view of the protective helmet device of FIG. 2.
Figure 13:
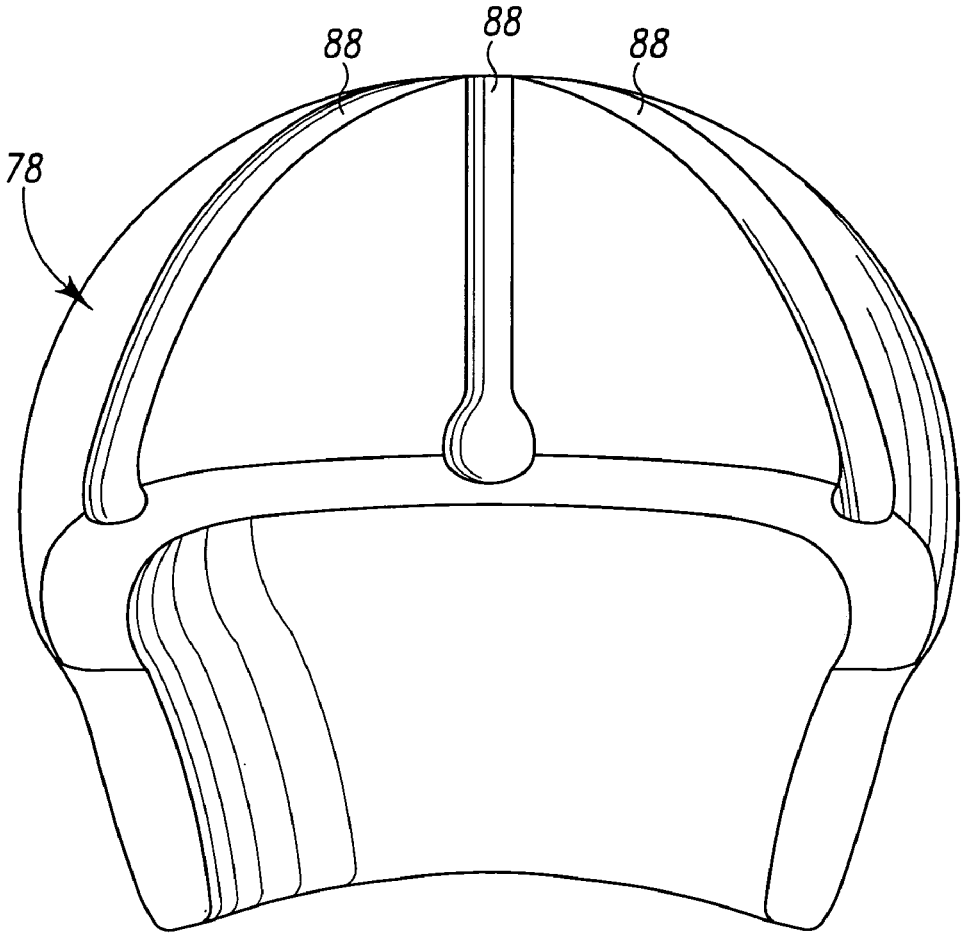
FIG. 13 is a front perspective view of the insert used in protective helmet device of FIG. 2.
Figure 14:
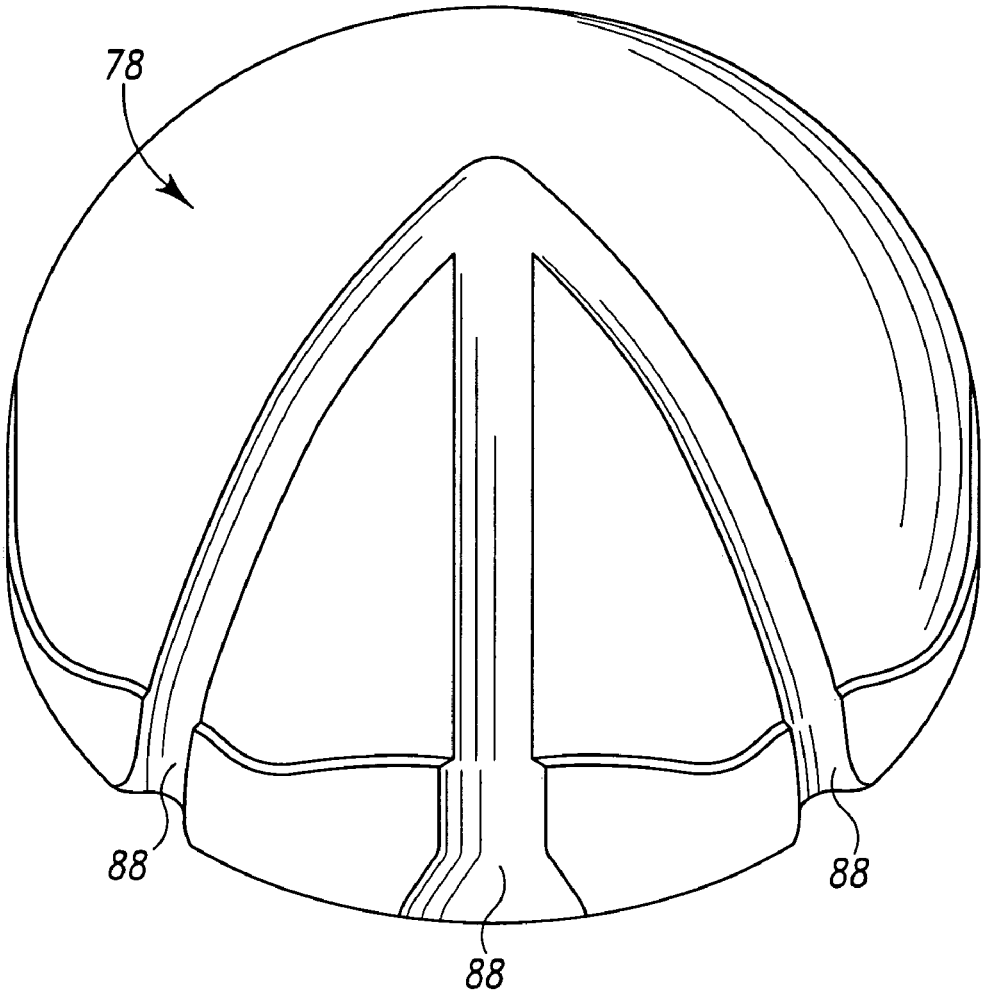
FIG. 14 is a top perspective view of the insert used in protective helmet device of FIG. 2.
Figure 15:
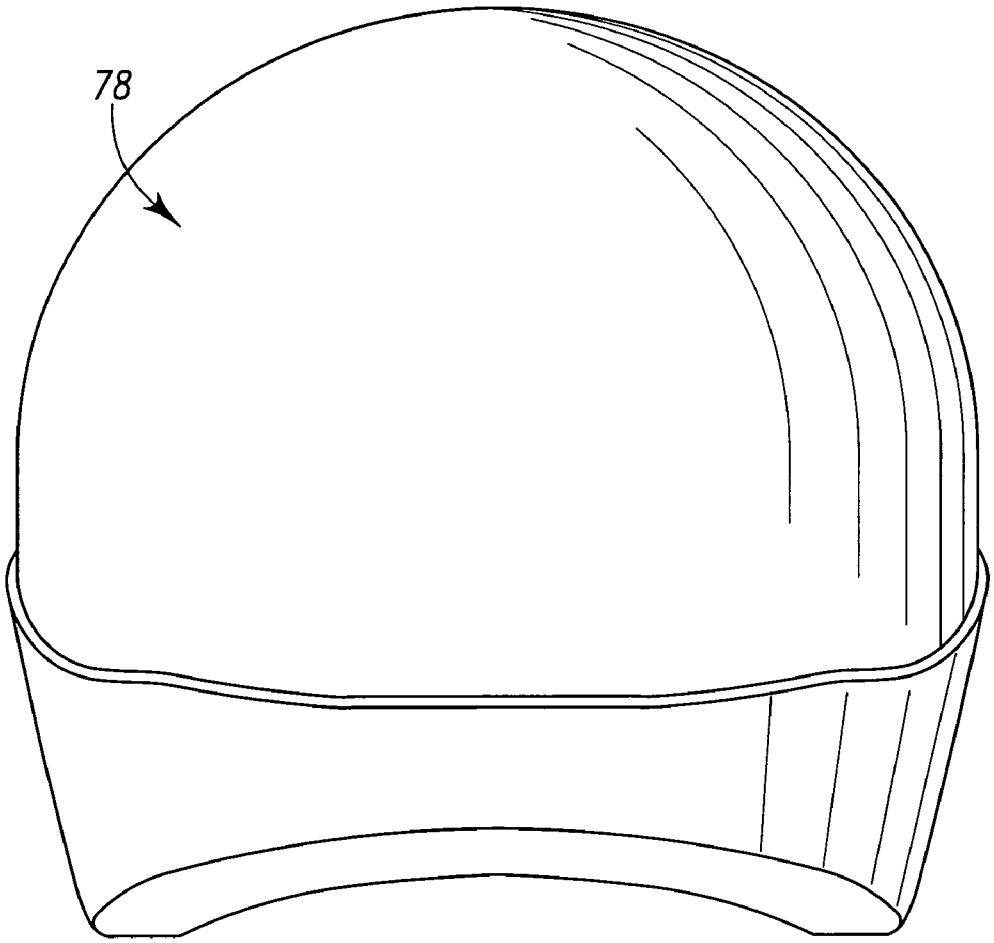
FIG. 15 is a rear perspective view of the insert used in protective helmet device of FIG. 2.

As shown in FIG. 12, protective helmet 50 also includes an insert 78 preferably comprising an impact-absorbing core (such as expanded bead polystyrene, polypropylene, or other suitable material as is known in the art) covered with a soft inner liner 80. The impact-absorbing insert 78 is coupled to the interior of shell 52. Bottom side 64 is open to allow entry of the wearer's head and has a protective flange 82 at the lowermost edge of the opening.

Referring now to FIGS. 7–11, tube inlet 84 is coupled to the outer shell 52 on the top side 54. Tube inlet 84 is also preferably made out of an impact-resistant material and is fastened to outer shell 52 via securing means 85, such as screws, glue, ultrasonic welding, or other suitable bonding means. Alternatively, tube inlet 84 may be formed integrally with shell 52. Tube inlet 84 is adapted to be coupled to an air supply, such as a race car's air conditioning system.

As shown in FIGS. 11–15, insert 78 is formed with multiple channels 88 formed into a surface thereof. Channels 88 of insert 78 are located on the inside of helmet 50 and are coupled to tube inlet 84 on the outside of helmet 50. Channels 88 preferably extend from a proximal end adjacent top side 54 of insert 78 to a distal end adjacent the upper portion of front side 60 of insert 78. Insert 78 contains slots 90 near the distal end of each channel 88 that allow air to flow from channels 88 to inside the helmet 50. The proximal ends of the channels 88 are positioned under tube inlet 84 and communicate therewith, such as through holes (not shown) formed through the shell 52 (if tube inlet 84 is not integrally formed with the shell 52). Alternatively, the multiple channels 88 can be formed through an interior of the insert 78 and communicate with a hole or holes formed through the surface of insert 78 adjacent the tube inlet 84.

When connected to an external air source, tube inlet 84 supplies air inside the helmet. Air travels into tube inlet 84, through channels 88, through slots 90 and into the interior of the helmet. With this embodiment, as with the first embodiment, air is blown downward, which clears the shield, keeps carbon monoxide from coming up into the helmet, and/or keeps air from blowing into and drying out the wearer's eyes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A protective helmet comprising:

a helmet shell formed from an impact-resistant material and having a top portions, a front portion, and an interior;

a shield coupled to the front portion of the shell;

an insert formed from an impact-absorbing material positioned in the interior of the helmet, the insert having at least one slot formed therein and extending through the insert;

a tube inlet coupled to the top portion of the shell, said inlet operable to be connected to a source of air, the tube inlet comprising a plurality of channels extending from a proximal channel end at the top portion of the shell to distal channel ends at the front portion of the shell above the shield;

wherein the distal channel ends are adjacent to the at least one slot; and wherein the tube inlet, the plurality of channels, and the at least one slot are constructed so that when the tube inlet is connected to the source of air, air travels downward into the tube inlet, through the plurality of channels, through the at least one slot, and into the interior of the helmet.

2. The protective helmet of claim 1, wherein the at least one slot comprises of plurality of slots.

3. The protective helmet of claim 1, wherein the tube inlet is formed integrally with the helmet shell.

4. The protective helmet of claim 1, wherein the insert is formed from expanded lead polystyrene.

5. The protective helmet of claim 1, wherein a first number of channels is equal to a second number of slots.

6. A protective helmet having an interior comprising:

a helmet shell for protectively enclosing a wearer's head, the helmet shell having a frontal hemisphere, a rear hemisphere, a top portion, and an interior, wherein said top portion extends into both the frontal and rear hemisphere and is the area of said helmet shell that protects the top of the wearer's head, wherein said frontal hemisphere is a front portion of said helmet shell that protects a wearer's face, wherein said rear hemisphere is the other portion of said helmet shell that protects the back of the wearer's head, wherein said interior is defined and enclosed by said shell;

a shield coupled to the frontal hemisphere of the shell;

an insert position in the interior of the shell for receiving the wearer's head, the insert having at least one channel formed therein and extending from a proximal end adjacent the top portion of the shell to a distal end generally adjacent the shield, said at least one channel enclosed within the frontal hemisphere, the insert further having at least one slot formed therein and extending through the insert, each of the at least one slots in fluid communication with a respective one of the at least one channels;

a tube inlet coupled to the top portion of the shell and in fluid communication with a portion of the at least one channel for airflow therebetween, the inlet operable to be connected to a source of air;

wherein the tube inlet, the at least one channel, and the at least one slot are constructed so that when the tube inlet is connected to the source of air, air travels downward into the tube inlet, through the at least one channel, through the at least one slot, and into the interior of the helmet.

7. The protective helmet of claim 6, wherein the at least one channel comprises a plurality of channels.

8. The protective helmet of claim 6, wherein the at least one slot comprises a plurality of slots.

9. The protective helmet of claim 6, wherein the tube inlet is formed integrally with the helmet shell.

10. The protective helmet of claim 6, wherein the insert is formed from expanded bead polystyrene.

11. The protective helmet of claim 6, wherein a first number of channels is equal to a second number of slots.

* * * * *

UNITED STATES PATENT AND TRADEMARK OFFICE

CERTIFICATE OF CORRECTION

PATENT NO. : 6,973,676 B1
DATED : December 13, 2005
INVENTOR(S) : Simpson

It is certified that error appears in the above-identified patent and that said Letters Patent is hereby corrected as shown below:

Title page,
Item [56], References Cited, FOREIGN PATENT DOCUMENTS, add:
-- EP 1 153 551 7/2004 --.

Column 5,
Line 38, change "portions" to -- portion --.

Column 6,
Line 2, change "comprises of plurality" to -- comprises a plurality --.
Line 6, change "lead" to -- bead --.

Signed and Sealed this

Twenty-first Day of March, 2006

JON W. DUDAS
*Director of the United States Patent and Trademark Office*